US011058196B2

(12) United States Patent
Chen et al.

(10) Patent No.: US 11,058,196 B2
(45) Date of Patent: Jul. 13, 2021

(54) MODULAR LUGGAGE WITH MULTIPLE LEVEL MODULAR DESIGN AND LINKABLE CASES

(71) Applicant: Shanda Group Pte., Ltd., Menlo Park, CA (US)

(72) Inventors: Tianqiao Chen, Menlo Park, CA (US); Hosen Ng, Singapore (SG)

(73) Assignee: SHANDA GROUP PTE. LTD, Menlo Park, CA (US)

( * ) Notice: Subject to any disclaimer, the term of this patent is extended or adjusted under 35 U.S.C. 154(b) by 434 days.

(21) Appl. No.: 16/057,595

(22) Filed: Aug. 7, 2018

(65) Prior Publication Data

US 2020/0046094 A1 Feb. 13, 2020

(51) Int. Cl.

| | |
|---|---|
| ***A45C 7/00*** | (2006.01) |
| ***A45C 5/03*** | (2006.01) |
| ***A45C 5/14*** | (2006.01) |
| ***A45C 15/00*** | (2006.01) |
| ***A45C 13/02*** | (2006.01) |
| ***A45C 13/26*** | (2006.01) |
| ***A45C 13/38*** | (2006.01) |

(52) U.S. Cl.

CPC ..... *A45C 7/0045* (2013.01); *A45C 5/03* (2013.01); *A45C 5/14* (2013.01); *A45C 7/005* (2013.01); *A45C 13/02* (2013.01); *A45C 13/262* (2013.01); *A45C 13/385* (2013.01); *A45C 15/00* (2013.01); *A45C 2013/025* (2013.01); *A45C 2013/267* (2013.01)

(58) Field of Classification Search

CPC ..... A45C 7/0045; A45C 7/005; A45C 13/02; A45C 2013/025; A45C 13/04; A45C 13/262; A45C 2013/267; A45C 13/38; A45C 13/385; A45C 15/00; A45C 5/03; A45C 5/14

USPC ..... 190/18 R, 18 A

See application file for complete search history.

(56) References Cited

U.S. PATENT DOCUMENTS

| | | | | |
|---|---|---|---|---|
| 4,538,709 A * | 9/1985 | Williams | A45C 3/004 190/18 A |
| 5,660,476 A * | 8/1997 | DeCoster | A45C 11/20 190/108 |
| 2002/0015538 A1* | 2/2002 | Snider | A45C 13/02 383/18 |
| 2003/0127296 A1* | 7/2003 | Saetia | A45C 13/385 190/18 A |

(Continued)

*Primary Examiner* — James N Smalley
*Assistant Examiner* — Jennifer Castriotta

(57) ABSTRACT

Described herein is a modular luggage system (the "MLS") that includes a modular case system that includes a plurality of interchangeable modular cases having a plurality of interchangeable compartments; a modular transport system that includes a plurality of interchangeable modular transport devices; a first chassis that includes a first chassis inner surface configured to releasably and interchangeably retain an interchangeable modular case selected from the modular case system; and a first chassis frame having attachment regions configured to releasably and interchangeably couple with an interchangeable modular transport device selected from the modular transport system. Also described are a coupling device for a MILS with multiple chassis, and corresponding methods for assembling the above MILS. A kit of parts for assembling the MLS is also described.

15 Claims, 9 Drawing Sheets

(56) References Cited

U.S. PATENT DOCUMENTS

| | | | | |
|---|---|---|---|---|
| 2003/0184034 | A1* | 10/2003 | Pfeiffer | A45C 5/143<br>280/47.29 |
| 2004/0074725 | A1* | 4/2004 | Shih | A45C 13/262<br>190/115 |
| 2007/0028642 | A1* | 2/2007 | Glade | F25D 3/06<br>62/371 |
| 2019/0142125 | A1* | 5/2019 | McAlister | A45C 13/262<br>190/18 A |

* cited by examiner

MODULAR LUGGAGE WITH MULTIPLE LEVEL MODULAR DESIGN AND LINKABLE CASES

TECHNICAL FIELD

The embodiments of the present invention generally relate to a modular luggage system, and more specifically, is directed to the system, method, and kit of parts for a modular luggage system with multiple level modular design and linkable cases.

BACKGROUND

In today's fast-paced business environment, business travelers are constantly on the move, traveling to new destinations and attending a variety of meetings and functions. The traveler must bring with him/her several luggage cases to accommodate the plethora of professional equipment and personal items for the rigorous demands of work.

While there are some luggage cases in prior art that allow travelers to add various attachments to the outer surface of a main luggage case. These bulgy luggage bags have neither the flexibility and convenience of a one-piece luggage nor the refined and clean appearance of a high-end briefcase. Often, the attached luggage would swing about, causing inconvenience to the traveler.

Therefore, what is needed in the art is a modular luggage system that provides flexibility to the user by applying a multi-level modular design, allowing the user to easily and quickly customize the composition of the luggage, size of the luggage, and means of transporting the luggage. At the one level, a user should be able to freely select a preferred luggage case and match it with a preferred mode of carrying the luggage. Furthermore, at a submodular level, the user should be able to further customize the functions and features of the luggage case by being able to add, remove, and rearrange its internal compartments.

SUMMARY

The presently disclosed embodiments are directed to solving issues relating to one or more of the problems presented in the prior art, as well as providing additional features that will become readily apparent by reference to the following detailed description when taken in conjunction with the accompanying drawings.

The present invention is directed to a modular luggage system (the "MLS") which uses interchangeable modular components to allow the user to customize and build the luggage with variable number of modular cases and a preferred mode of transporting the luggage.

According to a first major inventive aspect of the present invention, the MLS includes components categorized under one of three systems to allow a user to create any combination of the modular components. The three systems are: the chassis, the modular case system, and the modular transport system. The chassis provides the frame onto which the other two systems are attached. The modular case system allows the user to select from several interchangeable modular cases, preferably each designed with a distinctive function. Once the user has selected a case and has fitted it into the chassis, the modular transport system allows the user to choose from several modes of transporting the luggage.

As aforementioned, the chassis may be used to attach a modular case with a modular transport device. According to a preferred embodiment, the chassis has one or more projecting ridges along its inner surface to match one or more correspondingly-shaped grooves along the perimeter of a modular case. Using a standardized shape for the grooves on all of the modular cases, a chassis can be fitted with any one of the modular cases. When a chassis and a modular case are combined, it is herein referred to as a chassis-case assembly.

According to another embodiment, the chassis also has one or more attachment regions for connection with various interchangeable modular transport devices. For instance, a chassis may have D rings on both sides of the chassis frame to attach to the snap bolts on a sling. Alternatively, the chassis also has drill holes on both sides to attach to a trolley with telescopic handle.

According to a second major inventive aspect of the present invention, the MLS provides freedom to the user by applying multiple levels of modular design. At the one level, a user is provided the option to combine a modular case and a modular transport device selected from a plurality of modular cases and modular transport devices. The modularity allows customization based on one's preference and needs. At a level down, submodular design allows one to further customize the luggage system by adding, removing, and rearranging the submodular components of a particular modular case. The multiple levels of modular design allow a vast number of options. The submodular design covers various aspects of a modular case, including having multiple submodular compartments and submodular layers.

In one embodiment of the present invention, the MLS has an IT-equipped "business case". This modular case has a compartment for IT gadgets, a compartment for laptop computer, and an interlayer for satellite positioning system and power supply. Furthermore, the case also two submodular compartments, one for accessories and the other for stationaries. The submodular compartments are detachably connected to the outer surface of the modular case.

According to a third major inventive aspect of the present invention, the MLS can have one or more coupling devices to link together multiple chassis-case assemblies. This inventive aspect significantly expands the user's carrying capacity.

In one embodiment, the coupling device is a clip with opposing jaws for grasping two adjacent chassis. For example, three chassis-case assemblies are positioned side-by-side; a first chassis-case assembly is positioned the middle and is attached to a trolley with telescopic handle for transportation. A second and a third chassis-case assembly are positioned on each side of the first chassis-case assembly. Using a pair of clips, a first clip couples the first chassis-case assembly with the second chassis-case assembly, and a second clip couples the first chassis-case assembly with the third chassis-case assembly on the opposite side. Using this type of coupling device, the MLS is able to combine and transport at least three modular cases using a single modular transport device (i.e., a trolley with telescopic handle).

It should be noted that while the chassis-case assemblies could be designed to be identical to one another, it is conceivable that a person of ordinary skill in the art may design the chassis-case assemblies with slight variations, such as doing away with the attachment regions on the second and the third chassis-case assemblies.

The present invention also discloses corresponding methods for assembling the MLS and kits of parts for the MLS.

These and other embodiments of the present invention will also become readily apparent to those skilled in the art from the following detailed description of the embodiments having reference to the attached figures, the invention not being limited to any particular embodiment(s) disclosed.

BRIEF DESCRIPTION OF THE DRAWINGS

The present disclosure, in accordance with one or more various embodiments, is described in detail with reference to the following figures. The drawings are provided for purposes of illustration only and merely depict exemplary embodiments of the disclosure. These drawings are provided to facilitate the reader's understanding of the disclosure and should not be considered limiting of the breadth, scope, or applicability of the disclosure. It should be noted that for clarity and ease of illustration these drawings are not necessarily made to scale.

DETAILED DESCRIPTION OF EXEMPLARY EMBODIMENTS

The following description is presented to enable a person of ordinary skill in the art to make and use the invention. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the invention. Thus, embodiments of the present invention are not intended to be limited to the examples described herein and shown, but is to be accorded the scope consistent with the claims.

Embodiments disclosed herein are directed to a MLS comprising: a plurality of chassis; a modular transport system comprising a plurality of interchangeable modular transport devices; a modular case system comprising a plurality of interchangeable modular cases; and a plurality of coupling devices for linking together two or more chassis-case assemblies.

Figure 1:
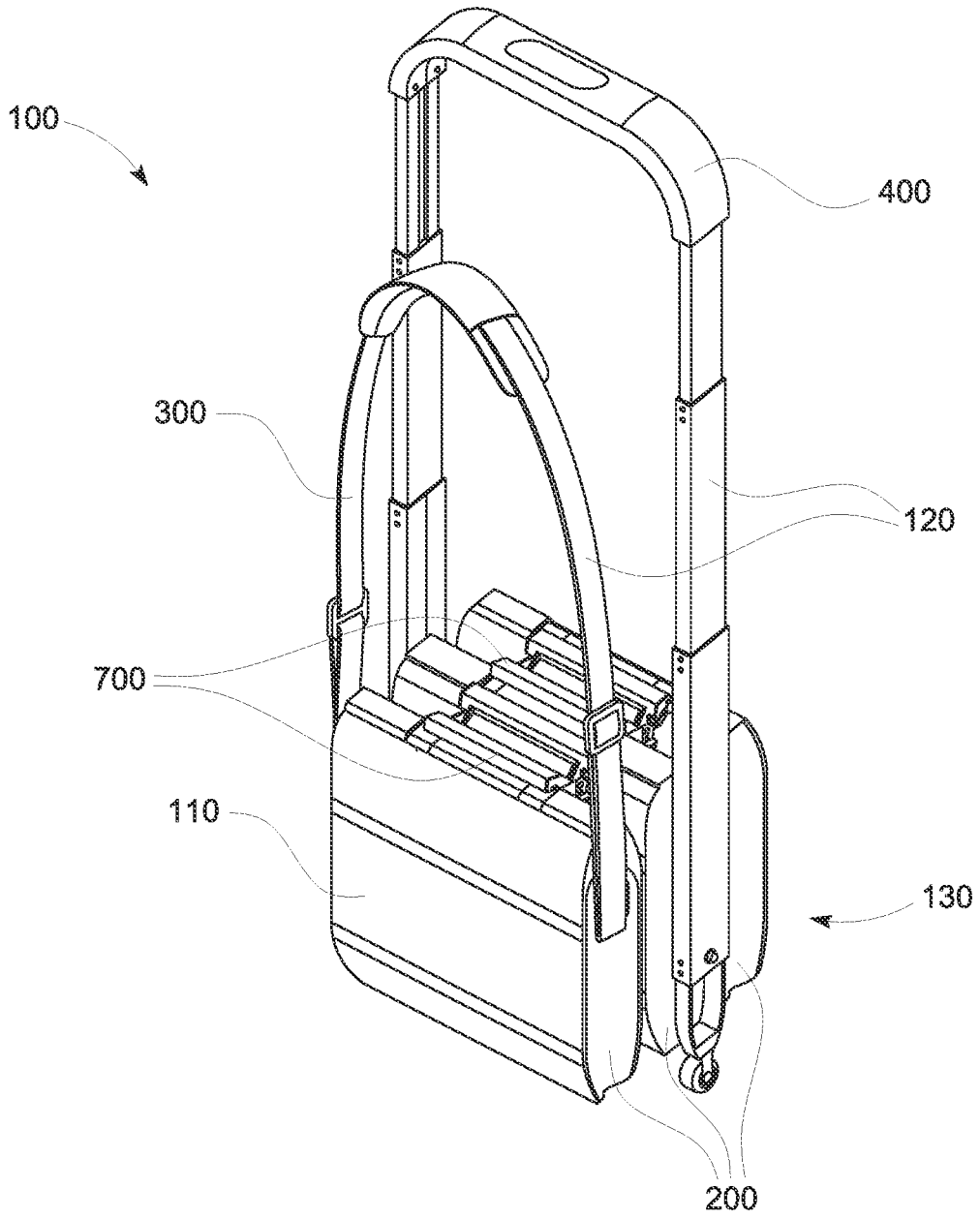
FIG. 1 illustrates a MLS in accordance with an embodiment.

FIG. 1 shows an exemplary MLS 100 in accordance with various embodiments of the invention discussed hereunder. The MLS 100 shown has a plurality of chassis and a plurality of modular cases assembled into several chassis-case assemblies 110 linked together according to embodiments of the invention. As shown in FIG. 1, the inventive MLS has the following major features: one or more chassis 200; a modular transport system 120 comprising a plurality of modular transport devices (e.g., a sling 300 and a trolley with telescopic handle 400); a modular case system 130 comprising a plurality of modular cases; and multiple coupling devices, such as a clip 700, for linking a plurality of chassis-case assemblies 110 together.

Figure 2A:
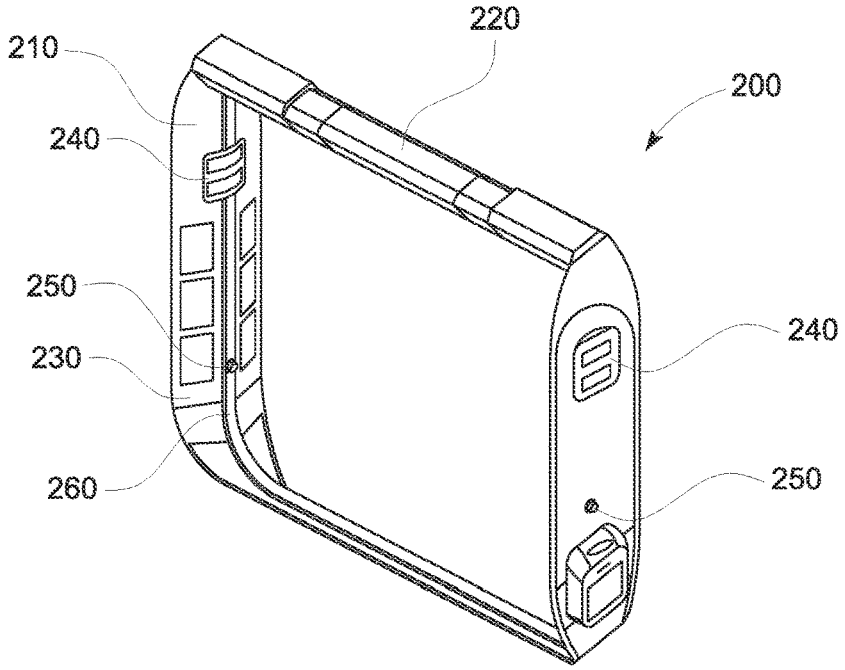
FIGS. 2*a-b* illustrate a chassis and its various components in accordance with an embodiment.
Figure 2B:
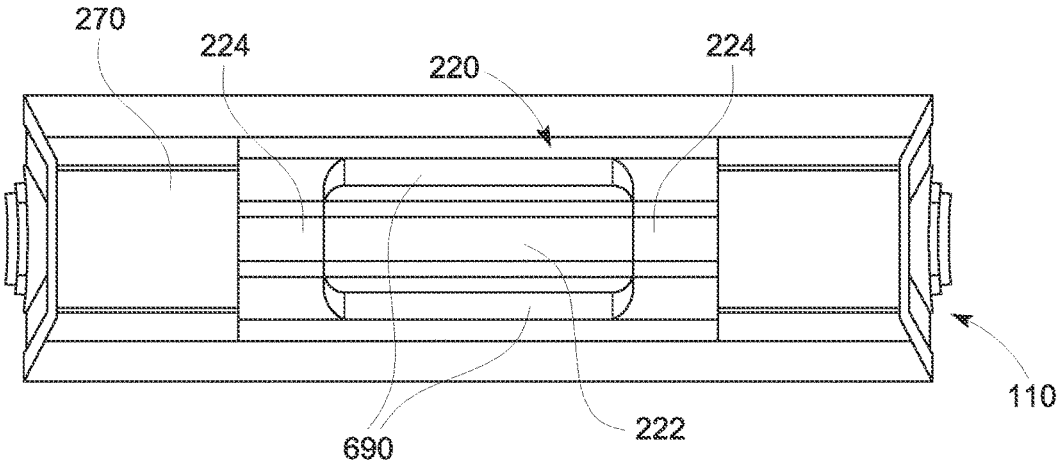

FIGS. 2*a* and 2*b* illustrate an embodiment of the chassis 200. As shown in FIG. 2*a*, the chassis 200 comprises a chassis frame 210, a chassis handle 220, a chassis inner surface 230, and several attachment regions for modular transport devices (e.g., D rings 240 for attaching a sling 300 and drill holes 250 for attaching a telescopic trolley 400). Projecting ridges 260 along the chassis inner surface 230 are configured to engage with complementary channels along the perimeter of a modular case, thereby enabling the chassis frame 210 to receive and securely retain the modular case inside the chassis 200. The chassis 200 combined with the modular case are referred to in this document as chassis-case assembly 110.

Furthermore, FIG. 2*a* also shows the attachment regions (e.g., D rings 240 and drill holes 250) for connecting the chassis 200 with a sling 300 and a trolley with telescopic handle 400. The attachment regions shown here are merely exemplary, other means of attaching modular transport devices to the chassis-case assembly 110 will be readily apparent to one of ordinary skill in the art.

FIG. 2*b* shows a top view of a chassis-case assembly 110; in particular, the chassis handle 220 and its peripheral. The chassis handle 220 comprises an elongated handle grip 222 connected to anchoring brackets 224 that are fixedly attached to a chassis outer surface 270. An excavated region 690 under and surrounding the handle grip 222 is excavated to allow a user to wrap fingers around the handle grip 222. Furthermore, the excavated region 690 serves as a coupling region for linking two or more chassis-case assemblies together; details of the coupling device are described in later paragraphs.

Figure 3:
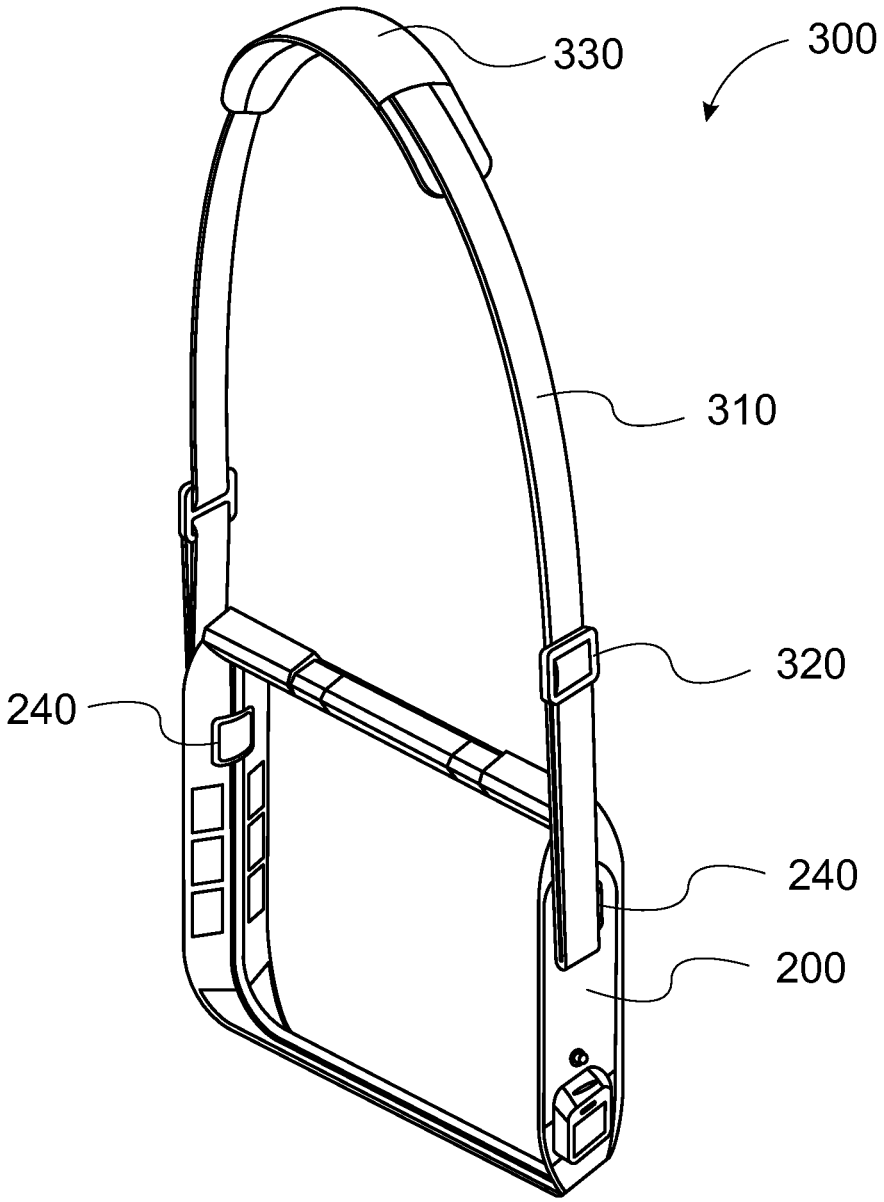
FIG. 3 illustrates a modular transport device in accordance with a first embodiment.
Figure 4B:
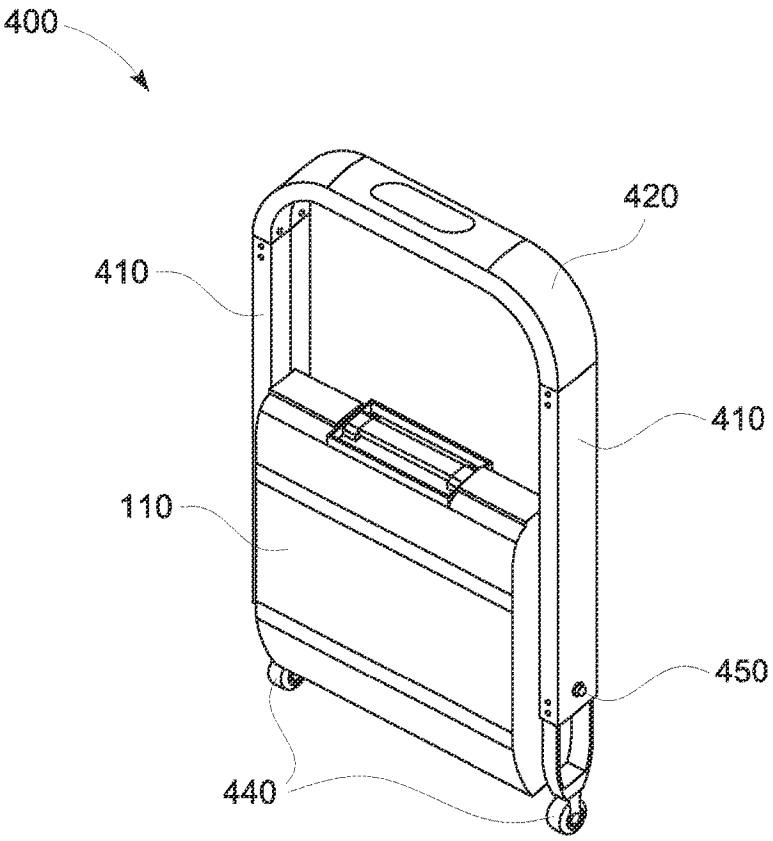
FIGS. 4*a-c* illustrate modular transport device in accordance with a second and a third embodiment.
Figure 4A:
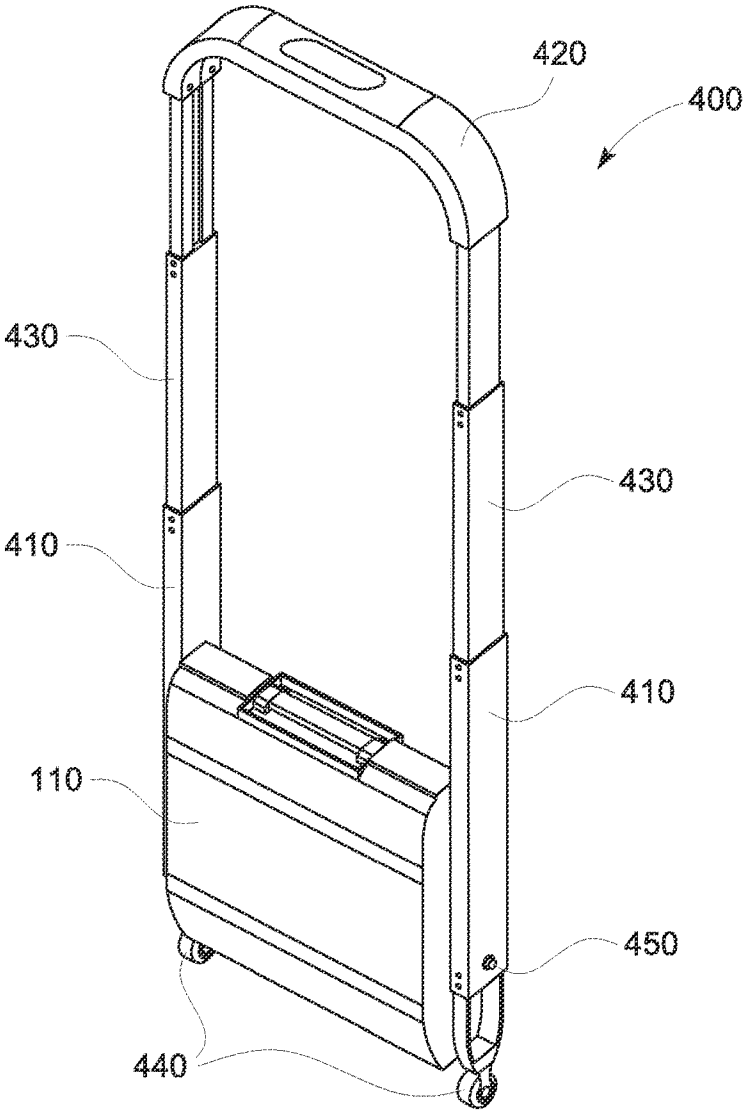
Figure 4C:
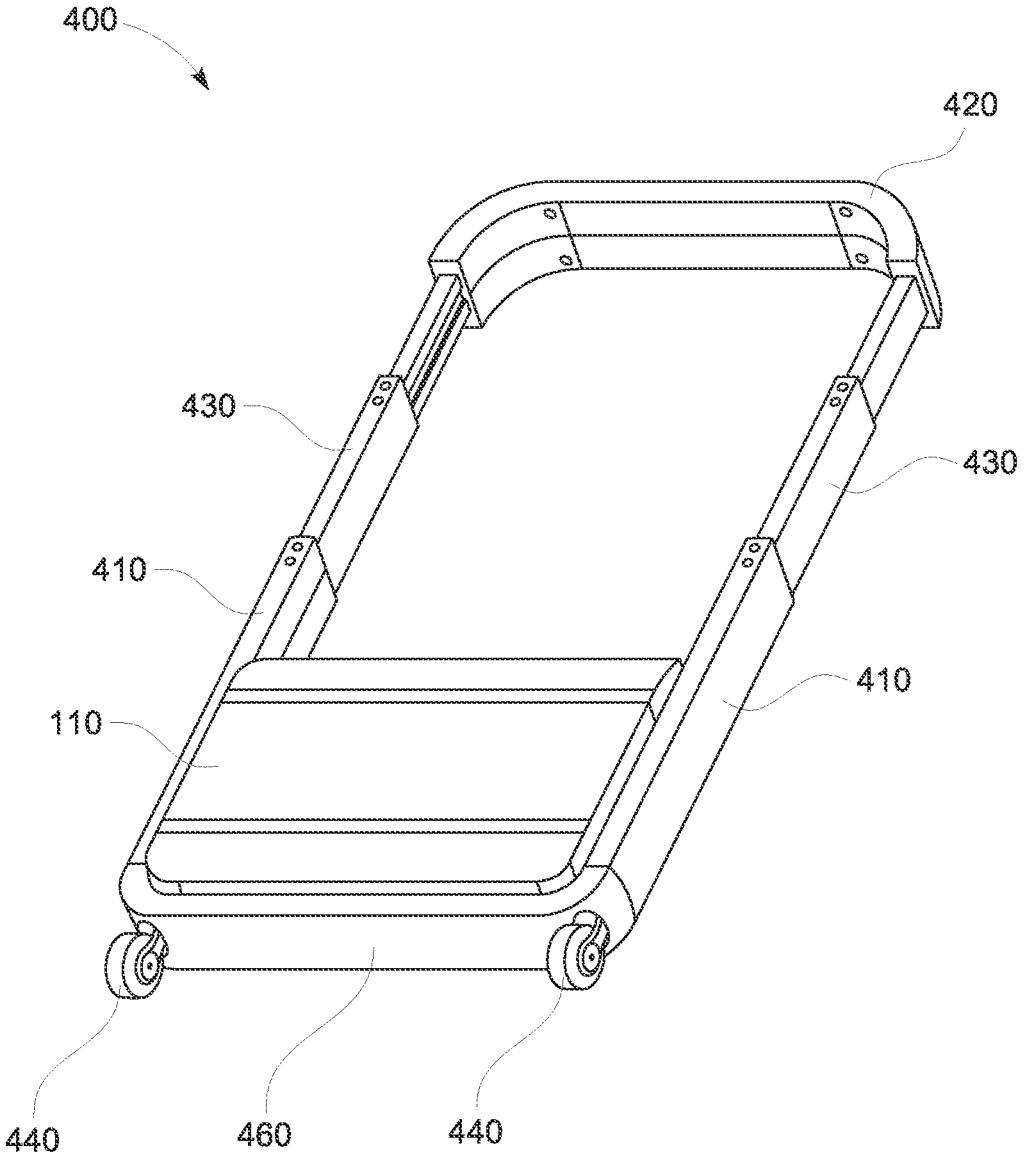

Turning attention to the modular transport system 120, FIGS. 3-4*c* illustrate several modular transport devices configured to attach to the chassis-case assemblies 110, including shoulder sling 300 and trolleys with telescopic handle 400.

Referring to FIG. 3, a sling 300 is fitted to a chassis-case assembly 110, thereby transforming the modular case into a briefcase with shoulder slings. FIG. 3 shows a sling 300 attached to a pair of D rings 240 on the chassis-case assembly 110. The sling 300 comprises a strap 310 with attaching members mounted on its either end. According to one exemplary embodiment, the attaching members are a pair of snap bolts adapted to attach to the pair of D rings 240 on the chassis frame 210. In another exemplary embodiment, the attaching members could simply be loops in the strap 310 itself (as shown), without the snap bolts. The sling 300 also comprises an adjustable slider 320 for adjusting the length of the strap 310 and a shoulder pad 330 for improving the comfort of the user.

Referring to FIGS. 4*a-c*, a trolley with telescopic handle is fitted to the MLS, thereby transforming it into a conventional wheeled luggage capable of being pulled along. FIGS. 4*a-c* disclose two exemplary embodiments of a trolley with telescopic handle configured to carry the luggage system, however other means of configuring a trolley with telescopic handle to the inventive luggage system will also be readily apparent to a person of ordinary skill in the art.

FIGS. 4*a* and 4*b* illustrate a first embodiment of the trolley with telescopic handle 400 attached to a chassis-case assembly 110. The trolley 400 comprises: a pair of fixed sheath tubes 410, a handle 420, a pair of retractable arms 430, and a pair of casters 440. The handle 420 joins the pair of retractable arms 430 at their respective top end, while the retractable arms 430 are configured to extend into and out of the sheath tubes 410. The pair of casters 440 are connected to the sheath tubes 410 at their respective bottom end. According to one embodiment, the chassis-case assembly 110 is securely connected to the trolley 400 in between the two sheath tubes 410 by a pair of screws 450. The screws 450 are threaded through a pair of small holes on either side of the sheath tubes 410 and then fastened to drill holes 250 located on the chassis 200. FIG. 4*a*, shows the trolley 400 in fully-extended mode for pulling along using the casters 440. Referring to FIG. 4*b*, the telescopic handle is retracted and the chassis-case assembly 110 can be carried using the handle 420 like a briefcase.

FIG. 4*c* shows another embodiment of the trolley 400 which uses an elongated bracket member 460 to hold the chassis-case assembly 110 in place. According to an embodiment, the bracket member 460 is positioned at the base of the trolley 400 with the ends of the bracket member 460 connected to the bottom end the sheath 410. Compared to the previous embodiment disclosed in FIGS. 4*a* and 4*b*, this embodiment has the added advantage of being able to easily and quickly install the chassis-case assembly 110 without the use of screws 450.

According to another inventive aspect of the invention, the MLS provides freedom to the user by applying multiple levels of modular design. As discussed in the foregoing paragraphs, a user is provided the option to combine a modular case and a modular transport device selected from a plurality of modular cases and modular transport devices. The modularity allows customization based on one's preference and needs. At a level down, submodular design allows one to further customize the luggage system by adding, removing, and rearranging the submodular components of a particular modular case.

Figure 5:
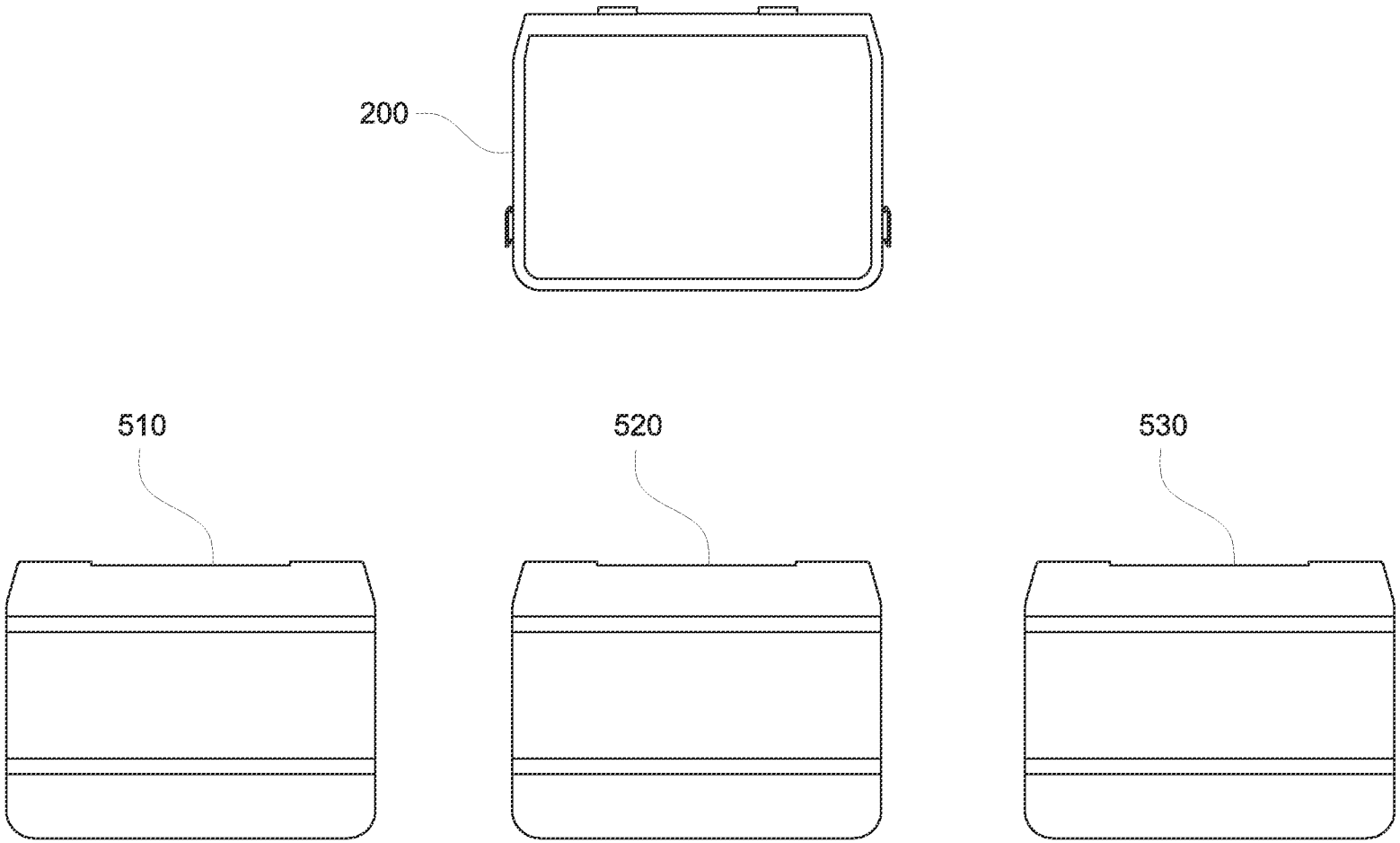
FIG. 5 illustrates a plurality of modular cases configured to combine with a chassis.

FIG. 5*a* illustrates an exemplary modular case system the modular case system with three cases: a business case 510 with IT functionalities, a conventional travel case 520, and a cultural case 530 for various cultural items. The three cases have substantially similar external dimensions so any of the modular cases can be fitted into the same chassis 200. Furthermore, the modular cases may further include submodular compartments for various functions.

Figure 6A:
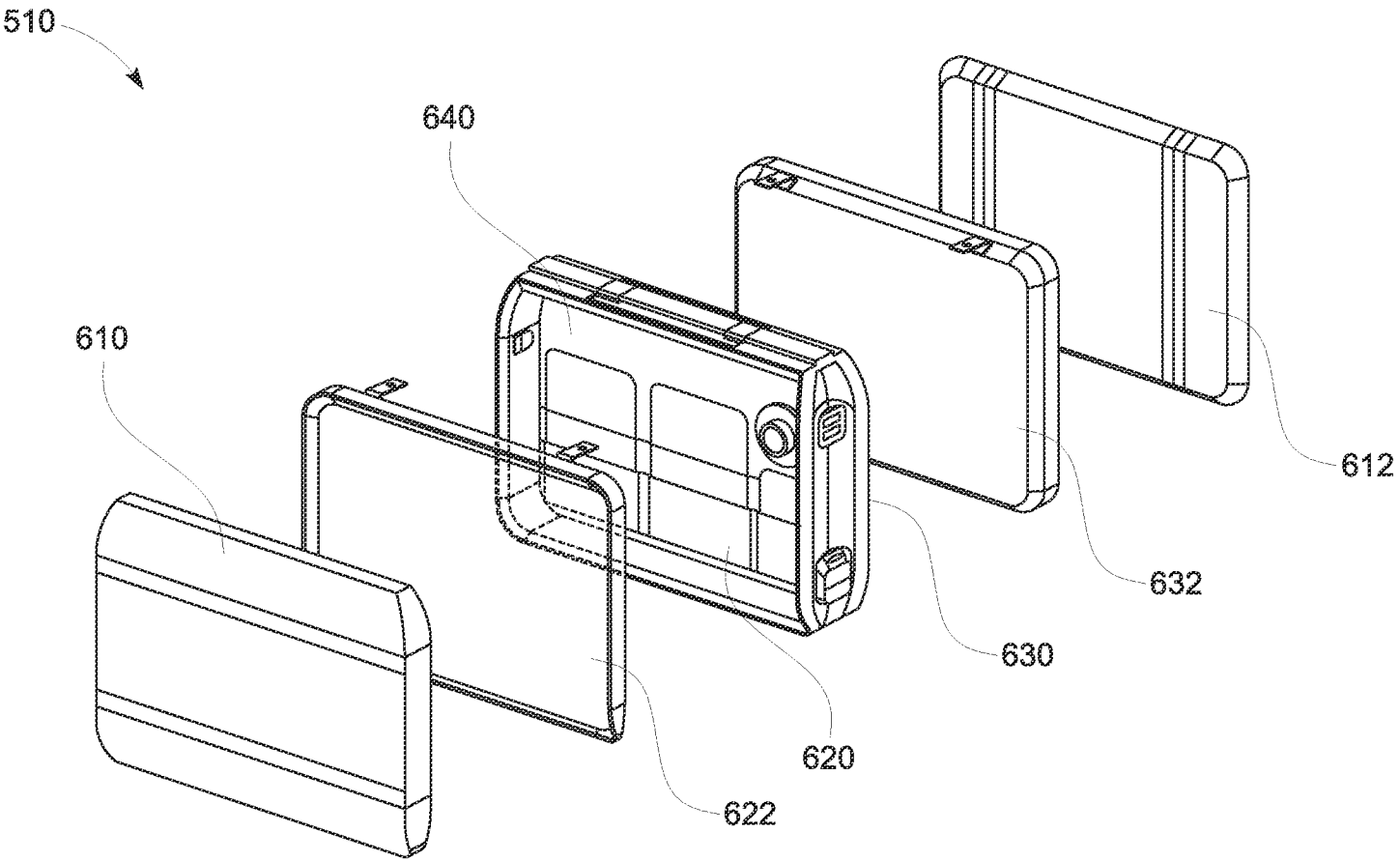
FIG. 6*a-c* illustrate a modular case configured with submodular compartments and an IT interlayer.
Figure 6B:
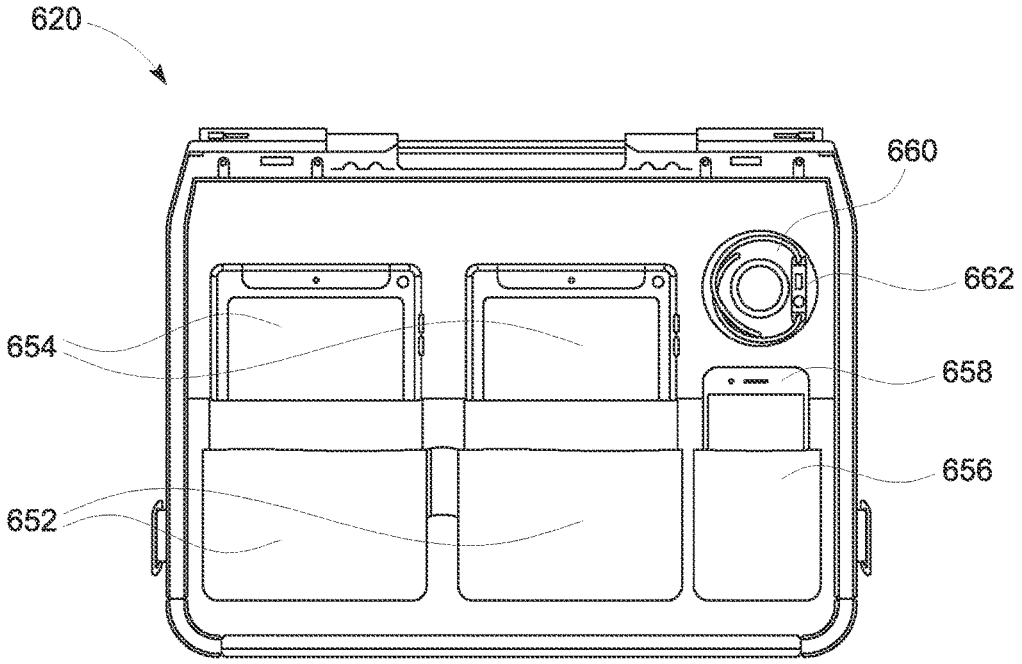
Figure 6C:
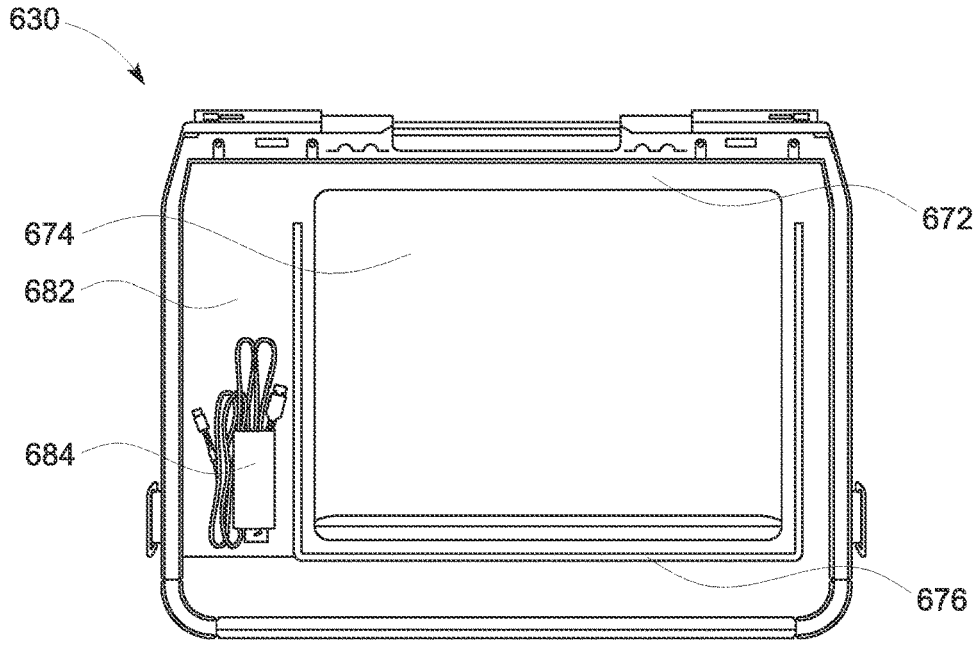

At the submodular level, the design extends the submodular flexibility to various aspects of the modular case, including having multiple submodular compartments and submodular layers. According to an exemplary embodiment of the business case 510, various submodular compartments may be removed from the chassis-case assembly 110 and be replaced with other submodular compartments having different internal configurations. FIGS. 6*a-c* illustrate the aforementioned embodiment of the business case 510 in detail.

FIG. 6*a* shows an exploded view of the business case 510. The business case has a submodular compartment for stationaries 610, a submodular compartment for accessories 612, a compartment for IT gadgets 620 and its cover 622, a compartment for laptop 630 and its cover 632, and an IT interlayer 640 for satellite positioning system (e.g., GPS) and power supply. The submodular compartments for stationaries 610 and accessories 612 are detachably mounted over the covers 622 632, respectively. According to one exemplary embodiment, the covers 622 632 for the compartments 620 630 can be removed, thereby exposing the underlying compartments 620 630 and their contents. According to another exemplary embodiment, the covers 622 632 and the underlying compartments 620 630 are hingeably connected to allow opening the covers 622 632 by pivot. The IT interlayer 640 is sandwiched between the compartment 620 630 to provide the user with GPS functionalities and battery power. According to one embodiment, the IT interlayer is built into the modular case 510.

FIG. 6*b* shows a front view of the compartment for IT gadgets 620. In this exemplary embodiment, the compartment 620 has two pockets 652 designed to fit tablet computers 654 (e.g., iPads), a phone pocket 656 for a smart phone 658, and a watch holder 660 for a watch 662 (e.g., Apple Watch).

Referring to FIG. 6*c*, a front view of the compartment for laptop 630 is shown. The compartment for laptop 630 is on the side of the business case 510 opposite the compartment for IT gadgets 620. The compartment 630 features a large laptop storage cubicle 672 for placing a laptop 674 and a three-sided bracket 676 for holding the laptop 674 in place. A small accessories cubicle 682 adjacent the computer storage cubicle 672 is reserved for placing the power supply 684 and other laptop accessories (not shown).

Figure 7A:
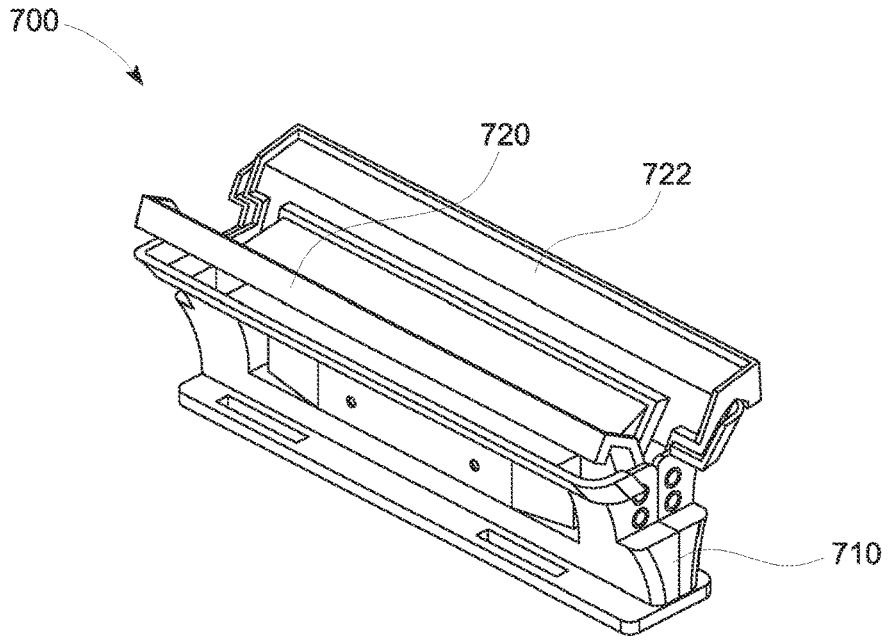
FIGS. 7*a-b* illustrate an exemplary coupling device for linking two or more chassis-case assemblies.
Figure 7B:
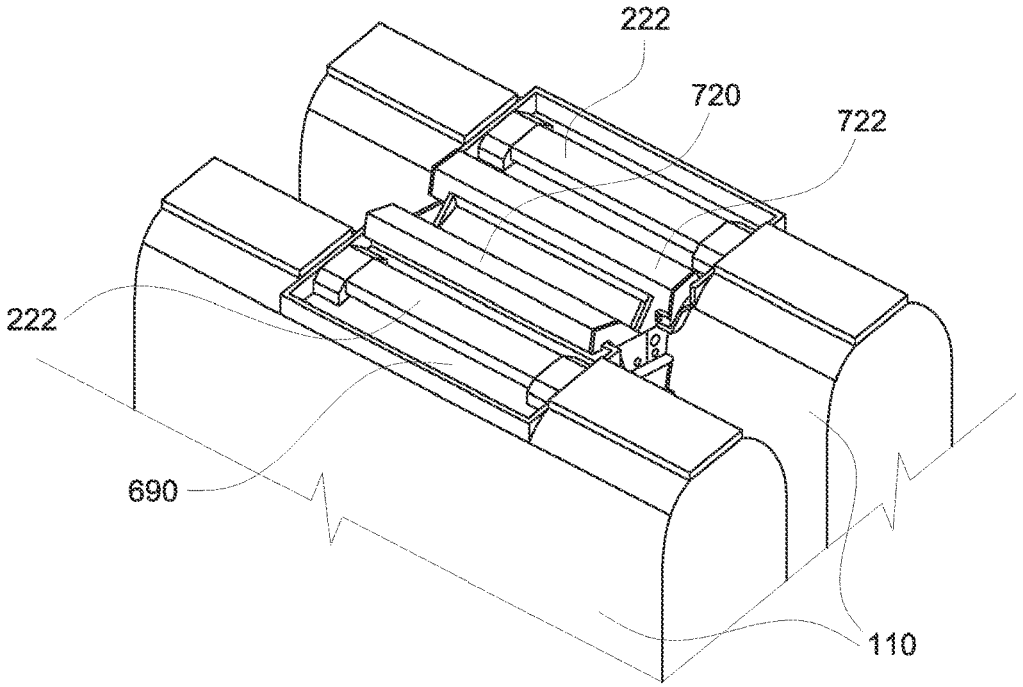

According to yet another embodiment of the invention, a user is able to use a coupling device to link two or more chassis-case assemblies 110 together. FIGS. 7*a* and 7*b* illustrate an exemplary coupling device in the form of a clip 700. Referring to FIG. 7*a*, the exemplary clip 700 has an elongated clip body 710 and a set of opposing jaws 720 722 configured to grasp onto two adjacent chassis-case assemblies 110. FIG. 7*b* shows the clip 700 engaged with two chassis-case assemblies 110. As can be seen, the excavated regions 690 surrounding the handle grips 222 form coupling regions for the clip 700. The rim of the excavated regions 690 allow the jaws 720 722 to grasp onto the chassis-case assemblies 110 and thereby linking the chassis-case assemblies 110 together.

The present invention also discloses a method of assembling a MLS. The method comprises:

- providing a modular case system comprising a plurality of interchangeable modular cases having a plurality of interchangeable compartments;
- providing a modular transport system comprising a plurality of interchangeable modular transport devices; and
- providing a first chassis comprising:
  - an inner surface having engaging means configured to releasably and interchangeably retain an interchangeable modular case selected from the modular case system; and
  - a chassis frame having attachment regions configured to releasably and interchangeably couple with an interchangeable modular transport device selected from the modular transport system; and
- combining together the first chassis, an interchangeable modular case selected from the modular case system, and an interchangeable modular transport device selected from the modular transport system.

The present invention further discloses a kit of parts for assembling a MLS. The kit comprises:

- a modular case system comprising a plurality of interchangeable modular cases having a plurality of interchangeable compartments;
- a modular transport system comprising a plurality of interchangeable modular transport devices; and
- a first chassis comprising:
  - a first inner surface having engaging means configured to releasably and interchangeably retain an interchangeable modular case selected from the modular case system; and
  - a first chassis frame having attachment regions configured to releasably and interchangeably couple with an interchangeable modular transport device selected from the modular transport system.

Expanding on the above kit, the present invention discloses yet another kit for an expanded MLS having a plurality of chassis and one or more clips. In addition to the above kit parts, the expanded MLS further comprises:

a second chassis comprising:

a second inner surface having engaging means configured to releasably and interchangeably retain an interchangeable modular case selected from the modular case system; and a second chassis frame having attachment regions configured to releasably and interchangeably couple with an interchangeable modular transport device selected from the modular transport system; and a coupling device comprising a clip having opposing jaws configured to couple the first chassis with the second chassis by grasping a first coupling region on the first chassis and a second coupling region on the second chassis.

What is claimed is:

1. A modular luggage system comprising:

a modular case system comprising a plurality of interchangeable modular cases having a plurality of interchangeable compartments;

a modular transport system comprising a plurality of interchangeable modular transport devices having attachment means;

a first chassis comprising:

a first chassis inner surface having engaging means configured to releasably and interchangeably retain an interchangeable modular case selected from the modular case system; and a first chassis frame having attachment regions configured to releasably and interchangeably couple with an interchangeable modular transport device selected from the modular transport system, wherein the first chassis frame comprises a first attachment region configured to releasably couple with a sling and a second attachment region configured to releasably couple with a trolley having a telescopic handle.

2. The modular luggage system of claim 1, wherein: the first chassis inner surface comprises an inwardly projecting ridge configured to engage with a complementary groove along a perimeter of the interchangeable modular case.

3. The modular luggage system of claim 1, wherein: the modular case system comprises a modular case embedded with a satellite positioning system and a power supply.

4. The modular luggage system of claim 1, wherein: the modular transport system comprises a sling and a trolley having the telescopic handle.

5. The modular luggage system of claim 1 further comprises:

a second chassis comprising:

a second chassis inner surface having engaging means configured to releasably and interchangeably retain an interchangeable modular case selected from the modular case system; and a coupling device configured to releasably link together the first chassis and the second chassis.

6. The modular luggage system of claim 5, wherein: the coupling device comprises a clip having opposing jaws configured to couple the first chassis with the second chassis by grasping a first coupling region on the first chassis and a second coupling region on the second chassis.

7. The modular luggage system of claim 5, wherein the second chassis further comprises:

a second chassis frame having attachment regions configured to releasably and interchangeably couple with an interchangeable modular transport device selected from the modular transport system.

8. The modular luggage system of claim 7, wherein: the coupling device comprises a clip having opposing jaws configured to couple the first chassis with the second chassis by grasping a first coupling region on the first chassis and a second coupling region on the second chassis.

9. A kit of parts for a modular luggage system comprising:

a modular case system comprising a plurality of interchangeable modular cases having a plurality of interchangeable compartments;

a modular transport system comprising a plurality of interchangeable modular transport devices, wherein the modular transport system comprises: a sling; and a trolley having a telescopic handle; and a first chassis comprising:

a first inner surface having engaging means configured to releasably and interchangeably retain an interchangeable modular case selected from the modular case system; and a first chassis frame having attachment regions configured to releasably and interchangeably couple with an interchangeable modular transport device selected from the modular transport system.

10. The kit of parts of claim 9, wherein the modular case system comprises: an interchangeable modular case having a satellite position system and a power supply.

11. The kit of parts of claim 9, further comprising:

a second chassis comprising:

a second inner surface having engaging means configured to releasably and interchangeably retain an interchangeable modular case selected from the modular case system; and a second chassis frame having attachment regions configured to releasably and interchangeably couple with an interchangeable modular transport device selected from the modular transport system; and a coupling device comprising a clip having opposing jaws configured to couple the first chassis with the second chassis by grasping a first coupling region on the first chassis and a second coupling region on the second chassis.

12. A method for assembling a modular luggage system, comprising:

providing a modular case system comprising a plurality of interchangeable modular cases having a plurality of interchangeable compartments;

providing a modular transport system comprising a plurality of interchangeable modular transport devices; and providing a first chassis comprising:

an inner surface having engaging means configured to releasably and interchangeably retain an interchangeable modular case selected from the modular case system; and a chassis frame having attachment regions configured to releasably and interchangeably couple with an interchangeable modular transport device selected from the modular transport system; and combining together the first chassis, an interchangeable modular case selected from the modular case system, and an interchangeable modular transport device selected from the modular transport system;

providing a second chassis comprising:

a second chassis inner surface having engaging means configured to releasably and interchangeably retain an interchangeable modular case selected from the modular case system;

combining together the second chassis and an interchangeable modular case selected from the modular case system;

providing a coupling device configured to releasably link together the first chassis and the second chassis; and coupling the second chassis to the first chassis with the coupling device.

13. The method of claim 12, wherein the coupling device comprises: a clip having opposing jaws configured to couple the first chassis to the second chassis by grasping a first coupling region on the first chassis and a second coupling region on the second chassis.

14. The method of claim 12, further comprising the steps of:

providing a second chassis comprising:

a second chassis inner surface having engaging means configured to releasably and interchangeably retain an interchangeable modular case selected from the modular case system; and a second chassis frame having attachment regions configured to releasably and interchangeably couple with an interchangeable modular transport device selected from the modular transport system; and combining together the second chassis and an interchangeable modular case selected from the modular case system;

providing a coupling device configured to releasably link together the first chassis and the second chassis; and coupling the second chassis to the first chassis with the coupling device.

15. The method of claim 14, wherein the coupling device comprises:

a clip having opposing jaws configured to couple the first chassis to the second chassis by grasping a first coupling region on the first chassis and a second coupling region on the second chassis.

* * * * *